United States Patent [19]

Nabulon

[11] Patent Number: 4,854,019

[45] Date of Patent: Aug. 8, 1989

[54] TEXTURIZING NOZZLE FOR ENDLESS FILAMENT THREADS

[75] Inventor: Werner Nabulon, Rüdlingen, Switzerland

[73] Assignee: Rieter Machine Works Ltd., Winterthur, Switzerland

[21] Appl. No.: 167,017

[22] Filed: Mar. 11, 1988

[30] Foreign Application Priority Data

Mar. 16, 1987 [CH] Switzerland ..... 00968/87

[51] Int. Cl.[4] ..... D02G 1/12; D02G 1/16

[52] U.S. Cl. ..... 28/255

[58] Field of Search ..... 28/255, 256

[56] References Cited

U.S. PATENT DOCUMENTS 4,188,691 2/1980 Matsumoto et al. ..... 28/255

4,631,790 12/1986 Nabulon ..... 28/255

FOREIGN PATENT DOCUMENTS 0163039 12/1985 European Pat. Off. .

*Primary Examiner*—Robert R. Mackey

*Attorney, Agent, or Firm*—Werner W. Kleeman

[57] ABSTRACT

An apparatus for texturizing endless filament threads comprises a thread infeed portion, a treatment portion and a crimping portion. The crimping portion is structured as a so-called slotted nozzle provided with lamellae arranged in a star-shaped array. The lamellae are insertably held at their upper ends and at extensions provided at their lower ends in substantially half-circular-shaped insert members provided with slots. The upper insert members are firmly received in a separable connector element and the lower insert members in a separable mouth portion. Furthermore, in accordance with the invention, the insert members possess cleaning grooves which in the opened condition, i.e. the separated condition of the connector element or mouth portion, as the case may be, can be cleaned, for example by utilization of compressed or pressure air, to enable removal of dirt or other contaminants from the slot base of the insert members.

7 Claims, 6 Drawing Sheets

TEXTURIZING NOZZLE FOR ENDLESS FILAMENT THREADS

BACKGROUND OF THE INVENTION

The present invention broadly relates to an apparatus for the treatment of threads of endless filaments and, more specifically, relates to a new and improved construction of a texturizing nozzle for texturizing of threads or the like of endless filaments, also referred to Generally speaking, the texturizing nozzle of the present development is of the type comprising a treatment portion for warming or heating the endless filament threads, a crimping portion for the endless filament threads which follows the treatment portion in a predeterminate direction of travel of the endless filament threads through the texturizing nozzle and a connector or connection element which connects the treatment portion with the crimping portion. There is also provided a mouth portion located at the outlet or outlet side of the crimping portion. Lamellae or thin plates or the like, are provided for the crimping portion and have upper ends which are insertably or pluggably connected in slots or slits provided at the connector or connection element as well as lower ends which are insertably or pluggably connected in slots or slits arranged at the mouth portion. The slots or slits of the connection element and the slots or slits of the mouth portion are positioned in a substantially star-like or radial configuration, that is to say, like the spokes of a wheel so that the lamellae are also arranged in such substantially star-like or radial configuration.

A texturizing nozzle of the aforementioned general construction is known from the commonly assigned European Published Patent Application No. 163,039, published Dec. 4, 1985, and the cognate U.S. Pat. No. 4,631,790, granted Dec. 30, 1986. In that prior art construction of texturizing nozzle, the texturizing portion of the texturizing nozzle comprises lamellae arranged in a radiating or star-like array. The ends of the lamellae facing upstream with respect to the direction of movement of the endless filament thread project into a connector portion and the ends of the lamellae facing downstream project into a mouth portion. In order to enable this to occur, slots corresponding to the cross-section of the lamellae are provided in the connector portion and mouth portion. The lamellae are held in these slots practically without play.

Notwithstanding this substantially play-free guidance of the ends of the lamellae in the associated slots, it is still possible for the slots, and thus also the related slot base, to become contaminated or fouled by spin finish applied to the endless filament threads. Hence, disturbances can arise upon exchange or replacement of the lamellae.

Since the lamellae, and hence the slots, have very small dimensions, cleaning of the slots is quite problematic and not always completely successful.

As an alternative to cleaning of the slots there is the possibility of exchanging the components or parts containing the slots. However, this is also extremely disadvantageous from the economic point of view.

A further construction of texturizing nozzle of the assignee of the present invention has been disclosed in U.S. Pat. No. 4,453,298, granted June 12, 1984.

SUMMARY OF THE INVENTION

Therefore with the foregoing in mind it is a primary object of the present invention to provide a new and improved construction of an apparatus for texturizing endless filament threads which does not suffer from the aforementioned drawbacks and shortcomings of prior art constructions.

Another and more specific object of the present invention aims at a new and improved construction of a texturizing nozzle for endless filament threads which enables relatively uncomplicated and reliable cleaning of the slots or slits receiving the lamellae or the like.

Yet a further noteworthy object of the present invention is directed to a new and improved construction of texturizing nozzle for endless filament threads which is structured such that insert members containing the slots or slits receiving the lamellae are accessible for cleaning purposes and structured to provide cleaning grooves so that the slots can be effectively cleaned of contaminants or the like, particularly at the region of the slot base.

Now in order to implement these and still further objects of the invention, which will become more readily apparent as the description proceeds, the texturizing nozzle for endless filament threads of the present development is manifested, among other things, by the features that the connection or connector element and the mouth portion or element are each separable or dividable into two substantially equal parts or portions. The slots or slits of each such part or portion are connected or communicate at their bases with one another by a substantially half-circular shaped cleaning groove or depression which is continuously open in the separated condition of the connector element or mouth portion, respectively.

A notable advantage of the present invention, resides in the fact that, due to the possibility of cleaning of the slots or slits at the base, greater freedom is afforded in the selection of the form or configuration of the slots or slits in that, for example, blowing out of these slots or slits can be performed from the inlet side as well as from the base side of the same.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
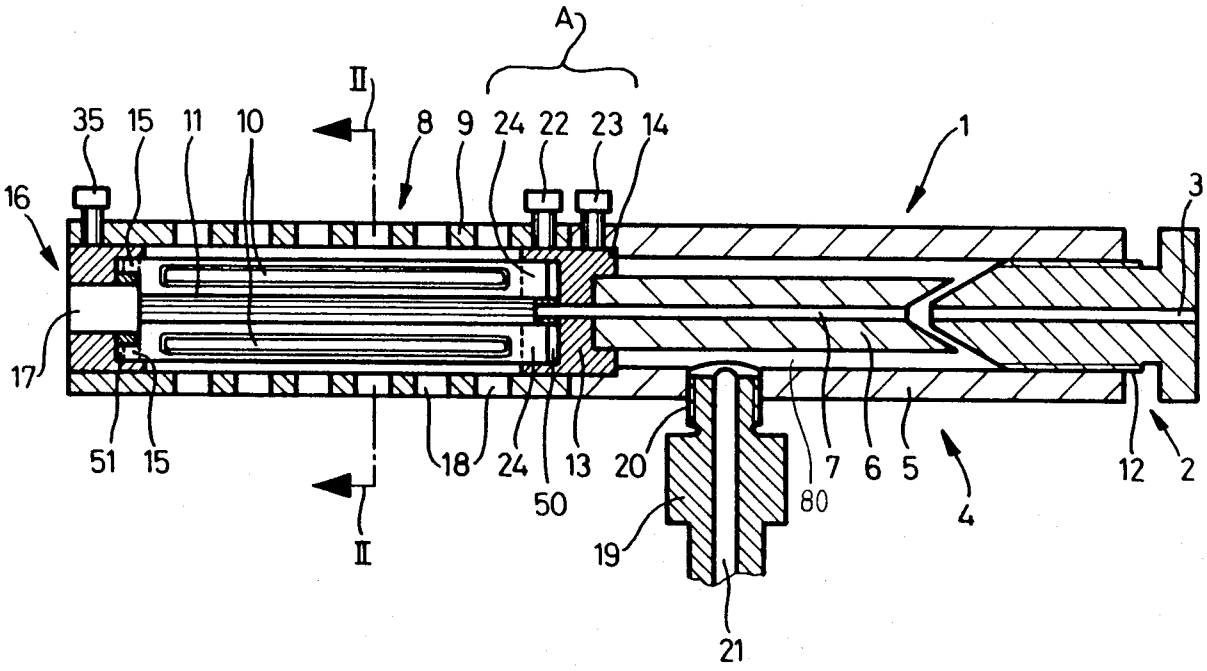
FIG. 1 illustrates a texturizing nozzle constructed in accordance with the present invention and depicted part-schematically in longitudinal sectional view taken substantially along the section lines I—I of FIG. 2.

Describing now the drawings, it is to be understood that to simplify the showing thereof, only enough of the texturizing apparatus, here the texturizing nozzle 1 for endless filament threads or the like has been illustrated therein as is needed to enable one skilled in the art to readily understand the underlying principles and concepts of this invention. Turning now specifically to FIG. 1 of the drawings, the exemplary embodiment of texturizing nozzle 1 depicted therein will be seen to comprise a thread infeed portion or part 2 provided with a thread infeed passage 3, a treatment portion or part 4 provided with an external tube 5 and an internal tube 6 therein containing a treatment chamber 7.

The texturizing nozzle 1 further comprises a crimping or texturizing portion or part 8 in communication with or following the treatment portion or part 4 with respect to the direction of travel or movement of the not shown endless filament threads through the texturizing nozzle 1. The crimping portion 8 has a perforated outer tube or tube member 9 and lamellae or relatively thin plate-like elements 10 provided therein to define a stuffing chamber 11 or the like.

The thread infeed portion or part 2 is connected to the outer tube or tube member 5 by means of a screwthread 12 or equivalent structure. The external tube or tube members 5 and the perforated tube or tube member 9 are centered by an inner connecting or connector element 13 and are connectable with and separable from each other by means of threaded bolts or screws 22 and 23. The connecting or connector element 13 also serves, on the one hand, to securely receive the inner tube or tube member 6, indicated by dash-dotted lines in FIG. 5 and, on the other hand, to insertably or pluggably receive the upper ends or portions 24 of the lamellae or lamella elements 10 (FIGS. 1 and 3) as viewed in the direction of movement of the thread or in the direction of viewing of FIG. 1.

The connecting or connector element 13 comprises two substantially equal, half-ring-shaped, joined halves or segments 13*a* (see FIG. 6) in which respective substantially half-ring-shaped insert members or inserts 26 are inserted. Each insert member or insert 26 is provided with slots or slits 25, as best seen by referring to FIGS. 5 and 6. Each insert or insert member 26 is seated in a half-ring-shaped recess 27 of the two halves or segments 13*a* of the connecting or connector element 13 and is firmly or fixedly secured thereto. Each such connection, for example, can be made by adhesive bonding, soldering or welding. Further, the two halves or segments 13*a* of the connecting or connector element 13 engage an internal abutment shoulder 14 provided on the external tube or tube member 5, only a portion of which external tube or tube member 5 has been shown in sectional view in FIGS. 5 and 10, and are firmly clamped in the outer tube or tube member 5 by the threaded bolts or screws 23.

The slots or slits 25 have a depth indicated by reference character T (FIG. 5) for receiving the upper ends or portions 24 of the lamellae 10. The radial centering of these upper ends 24 of the lamellae 10, is achieved in that the play between the width B of the slots or slits 25 and the width B.1 of the upper ends 24 of the lamellae 10 is chosen such that these lamellae upper ends 24 are slidingly guided into the slots or slits 25 practically without play during insertion into such slots or slits 25.

Figure 5:
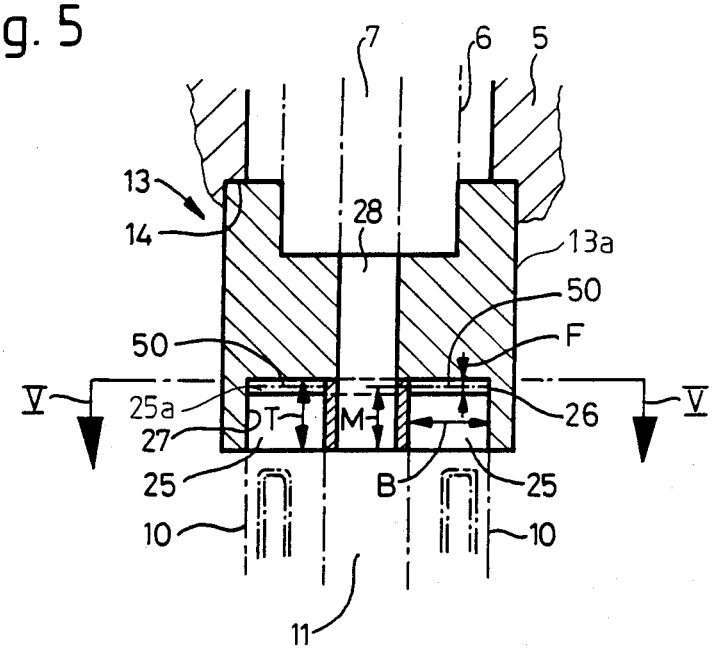
FIG. 5 is a longitudinal sectional view through a detail, in accordance with the invention, of the texturizing nozzle of FIG. 1, taken substantially along the section line IV—IV of FIG. 6 and drawn to a larger scale.
Figure 6:
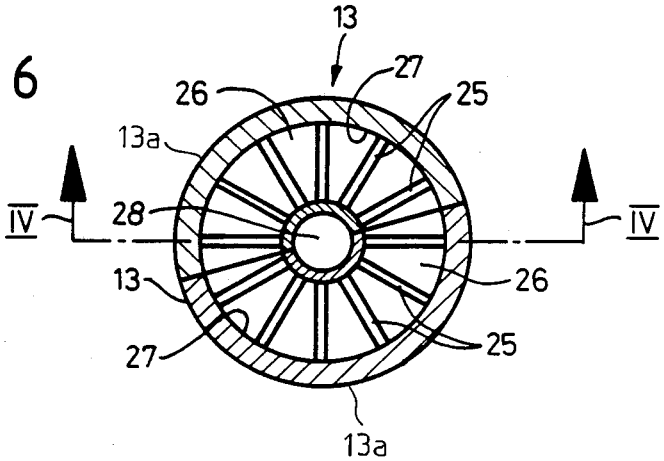
FIG. 6 is a cross-sectional view through the detail of FIG. 5 taken substantially along the section line V—V thereof.

The depth of penetration M of the lamellae upper ends 24 is smaller than the slot depth T as indicated with dash-dotted lines in FIG. 5.

Furthermore, each insert or insert member 26 has a half-ring-shaped recess or depression, designated herein as a cleaning groove 50, with a depth F and the same width as the width B of the slots or slits 25. With the aid of this cleaning groove 50 or equivalent structure it is possible to effectively clean each slot base 25*a* in the disassembled state or condition of the connecting or connector element 13, i.e. when the connecting or connector element is removed from the outer tube or tube member 5 and the perforated tube or tube member 13 and is opened up or sectionalized. Cleaning can be performed by any suitable cleaning medium, such as compressed or pressure air, for example.

The tolerances of the slots or slits 25 and the portions of the lamellae 10 projecting into such slots or slits 25 are selected on all sides such that the upper ends or portions 24 of the lamellae 10 are firmly guided, i.e. practically without free play, in the corresponding slot or slit 25.

The connecting or connector element 13 also has a connecting bore 28 which connects the treatment chamber 7 with the stuffing chamber 11.

Figure 3:
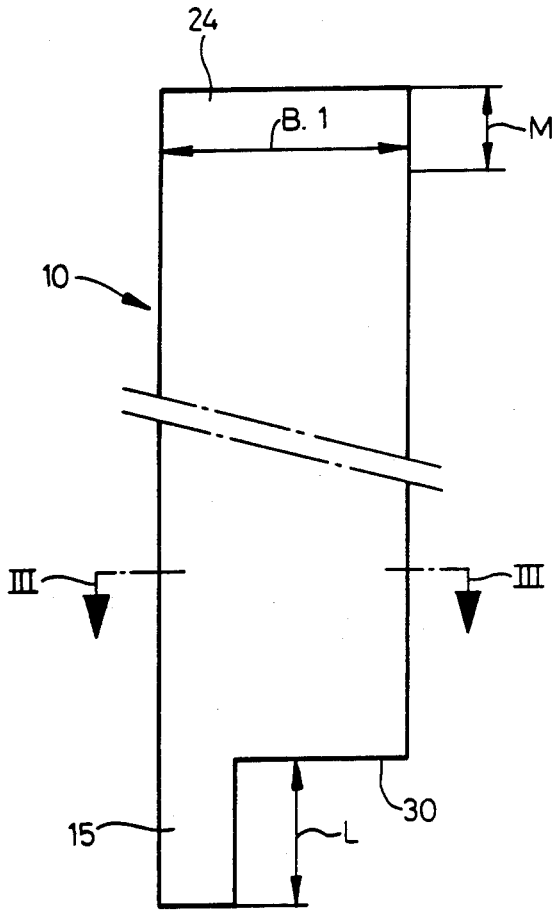
FIG. 3 is a view of part of the texturizing nozzle of FIG. 1 drawn to a larger scale and specifically depicting details of one of the lamellae or plate-like elements.
Figure 4:
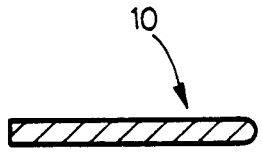
FIG. 4 is a cross-sectional view of the lamella or lamella element depicted in FIG. 3 taken substantially along the section-line III—III of FIG. 3.
Figure 12:
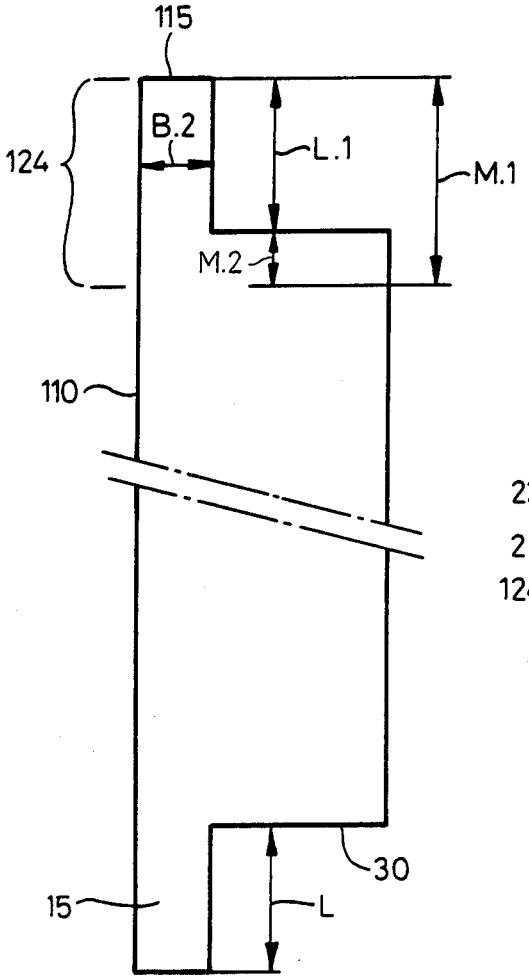
FIG. 12 illustrates a variant construction of the lamella or lamella element depicted in FIG. 3.
Figure 9:
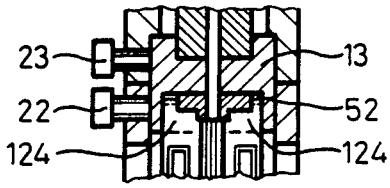
FIG. 9 is a sectional view of the portion of the texturizing nozzle designated by reference character A in FIG. 1 and depicting a variant of the structure shown in FIG. 5.

The lower ends or portions, as viewed in FIGS. 3 and 12, of the lamellae 10 are formed as extensions or projections 15 which are also firmly received in slots or slits 29 provided in a mouth portion or element 16. The length L of the extension or projection 15 is somewhat longer than the depth of penetration t (FIG. 7) of the extension or projection 15 so that the end surfaces 30 (FIGS. 3 and 12) of the lamellae 10 do not engage the inner end face or surface 31 of the mouth portion or element 16.

Furthermore, the tolerances of the extensions or projections 15 and of the slots or slits 29 are so selected on all sides that each extension or projection 15 is firmly guided in the associated slot or slit 29, i.e. practically without free play.

Figure 2:
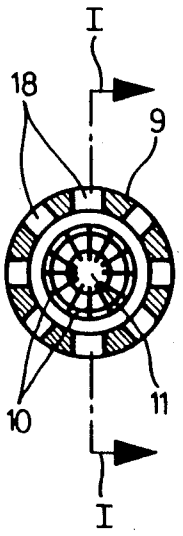
FIG. 2 is a cross-sectional view of the texturizing nozzle depicted in FIG. 1 and shown part-schematically and in sectional view taken substantially along the section line II—II of FIG. 1.

A lamella or lamella element 10 is inserted into each slot or slit 25 and 29, so that these inserted lamellae 10 are arranged in a radiating or star-shaped or radial array as shown in FIG. 2.

The mouth portion or element 16 also comprises substantially equal halves or segments 16*a*, just as was the case for the connecting or connector element or portion 13, and these two halves or segments 16*a* each consist of a half-ring-shaped insert body 32 provided with the slots or slits 29, and a half-ring-shaped sleeve portion or part 33 surrounding this insert body 32. The insert bodies 32 are connected to respective half-ring-shaped sleeve portions or parts 33. Again, such connection can be accomplished, for instance, by means of a soldering, welding or adhesive binding operation or process as described for the connecting or connector element 13.

Figure 7:
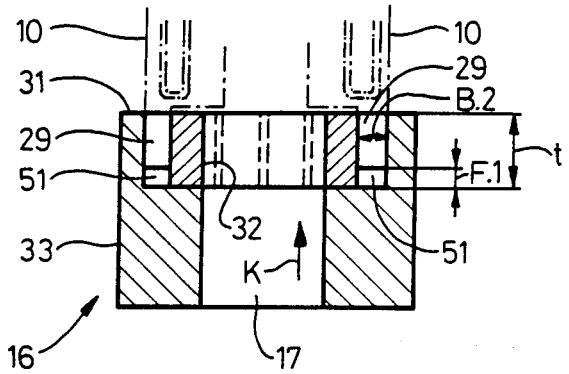
FIG. 7 is a longitudinal sectional view through a further detail, in accordance with the invention, of the texturizing nozzle of FIG. 1, taken substantially along the section line VI—VI of FIG. 8 and drawn to a larger scale.
Figure 8:
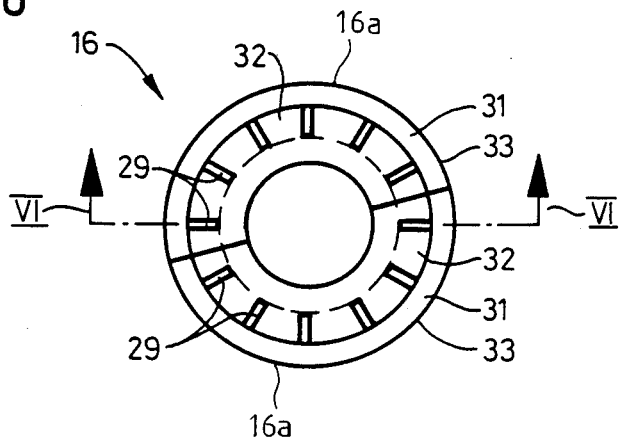
FIG. 8 is a plan view of the detail depicted in FIG. 7.

In a similar manner to the insert member 26 of the connecting or connector element 13, each insert body 32 has a cleaning groove 51 or equivalent structure of a width having a depth F.1 as viewed in the direction of viewing as indicated by reference character K in FIG. 7.

The depth F and the depth F.1 are empirically determined such that contaminants such as dirt or the like collected in these cleaning grooves 50 and 51 can be again conveniently blown away, for instance, by means of compressed or pressure air.

The mouth portion or element 16 has a mouth opening 17 through which the crimped thread (not shown) and part of the treatment medium leave the treatment nozzle 1.

The other part of the treatment medium, which passes between the lamellae 10, escapes through the exit or outlet openings 18 of the perforated tube or tube member 9.

A connecting stud or connector 19 or equivalent structure, secured in the outer tube or tube member 5 by means of a screw-thread 20 or the like, serves to feed a suitable treatment medium or fluid to the treatment apparatus, here specifically the treatment nozzle 1.

In particular, the treatment medium is fed via a feed passage 21 in the connecting stud or connector 19 into member 5 and the internal tube or tube member 6 and from that location into the treatment chamber 7.

A threaded bolt or screw 35 or equivalent fixing facility, which has been inserted into the perforated tube or tube member 9, serves to secure the mouth portion or element 16 at the outlet side of the crimping portion 8.

Figure 10:
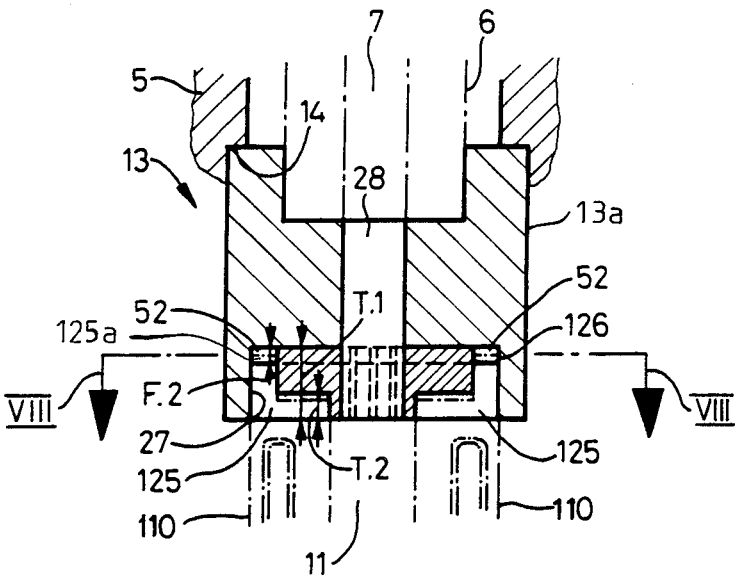
FIG. 10 is a longitudinal sectional view through a variant of the detail depicted in FIG. 5 and taken substantially along the section line VII—VII of FIG. 11 and drawn to a larger scale.
Figure 11:
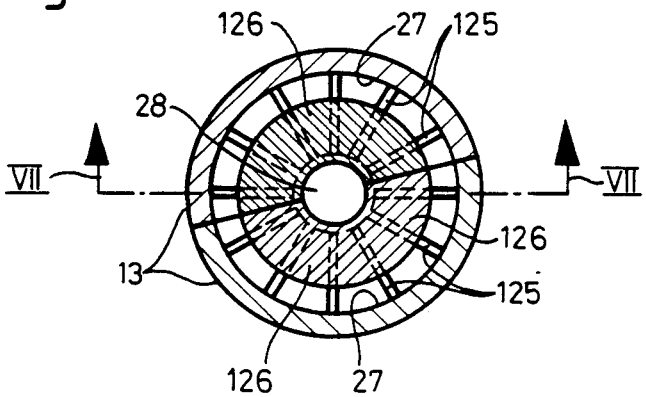
FIG. 11 is a cross-sectional view through the detail of FIG. 10 taken substantially along the section line VIII—VIII of FIG. 10.

FIGS. 9 to 12 show variant constructions of the arrangement of FIGS. 1, 3, 5 and 6, the same parts being generally conveniently designated by the same reference characters. The variant constructions assume that the lamellae or lamella elements 110 shown in FIG. 12 each have, in addition to the lower extension or projection 15, as viewed in FIG. 12, at each opposite end an upper extension or projection 115 possessing a length L.1. In order to be able to insert the upper portion or part of the lamella 110 containing the extension or projection 115 into an associated one of the slots or slits 125 provided in the half-ring-shaped insert members 126 with a depth of insertion M.1, these slots or slits 125 have a substantially L-shaped configuration as illustrated in FIG. 10. The slot depth T.1 or T.2 (FIG. 10) is greater than the depth of penetration M.1 or M.2 (FIG. 12), respectively. Additionally, the half-ring-shaped insert members 126 are connected with the half-ring-shaped sleeve segments 13*a* of the connecting or connector element 13 in the same manner as the insert members 26. Equally, the tolerances of the slots or slits 125 and the upper portions or parts 124 of the lamellae 110 inserted into the slots or slits 125 are selected on all sides such that the upper end 124 of each lamella 110 is firmly guided in the associated slot or slit 125, i.e. practically without free play.

In a similar manner to the insert member 26 each half-ring-shaped insert member 126 has a half-ring-shaped cleaning groove 52 or the like near the slot bases 125*a*, with a depth F.2 (FIG. 10) and a width B.2 corresponding to the width of the extension or projection 115 (FIG. 12). The depth F.2 is chosen empirically as described previously for the depth F.1.

The slots or slits 25 or 125 and 29 are advantageously formed by means of spark erosion machining. The slots or slits 25 and 29 can also be formed by milling.

It should be understood that even though the texturizing nozzle 1 has been described and illustrated as a round body, only the array of lamellae 10 or 110 is advantageously arranged in a round or circular configuration in order to enable production of the cleaning grooves 50 or 51 or 52 in a simple manner by utilizing a turning or lathe operation. However, a basically different manner of forming or manufacturing the cleaning grooves or the like, makes no difference in terms of the principles of the present invention.

Finally, it is noted that the lamellae preferably substantially close the radially arranged or extending slots or slits of the connector element and the mouth portion.

While there are shown and described present preferred embodiments of the invention, it is to be distinctly understood that the invention is not limited thereto, but may be otherwise variously embodied and practiced within the scope of the following claims. Accordingly,

What I claim is:

1. A texturizing nozzle for endless filament threads moving therethrough in a predeterminate direction of travel, comprising:

a thread infeed portion for infeeding endless filament threads;

a treatment portion following and adjoining said thread infeed portion;

said treatment portion containing means for infeeding a treatment fluid for drawing the endless filament threads through the thread infeed portion into the treatment portion and for heating the endless filament threads in said treatment portion;

a crimping portion following the treatment portion with respect to the predeterminate direction of travel of the endless filament threads;

said crimping portion having an outlet side for the endless filament threads;

a connector element connecting the treatment portion with the crimping portion;

a mouth portion provided at the outlet side of the crimping portion;

lamellae provided for the crimping portion;

each of said lamellae having an upper end and a lower end;

said connector element being provided with substantially radially arranged slots for receiving the upper ends of the lamellae;

each of said substantially radially arranged slots of said connector element having a slot base;

said mouth portion being provided with substantially radially arranged slots for receiving the lower ends of the lamellae;

each of said substantially radially arranged slots of said mouth portion having a slot base;

said upper ends of said lamellae being insertably retained in the substantially radially arranged slots of the connector element and the lower ends of the lamellae being insertably retained in the substantially radially arranged slots of the mouth portion;

said connector element being divided into two substantially equal parts which are separable from one another;

said mouth portion being divided into two substantially equal parts which are separable from one another;

said substantially radially arranged slots of each part of said connector element being connected together at said slot bases by a half-circular-shaped cleaning groove which is open in the separated condition of the connector element; and said substantially radially arranged slots of each part of said mouth portion being connected together at said slot bases by a half-circular-shaped cleaning groove which is open in the separated condition of the mouth portion.

2. The texturizing nozzle as defined in claim 1, wherein:

said cleaning groove of said connector element 1 possesses a substantially ring-shaped configuration when the connector element is joined together at the separable parts thereof and only has openings defined by the substantially radially arranged slots of said separable parts.

3. The texturizing nozzle as defined in claim 2, wherein:

each part of said connector element possesses a substantially half-ring-shaped insert member firmly connected thereto and in which there are provided said substantially radially arranged slots and said cleaning groove.

4. The texturizing nozzle as defined in claim 1, wherein:

said cleaning groove of said mouth portion possesses a substantially ring-shaped configuration when the mouth portion is joined together at the separable parts thereof and only has openings defined by the substantially radially arranged slots of said separable parts.

5. The texturizing nozzle as defined in claim 4, wherein:

each part of said mouth portion possesses a substantially half-ring-shaped insert member firmly connected thereto and in which there are provided said substantially radially arranged slots and said cleaning groove.

6. The texturizing nozzle as defined in claim 1, wherein:

the lamellae substantially close the substantially radially arranged slots of said connector element and said mouth portion.

7. A texturizing apparatus for endless filament threads moving in a predeterminate direction of travel, comprising:

a thread infeed portion for infeeding the endless filament threads;

a treatment portion following and adjoining said thread infeed portion;

said treatment portion containing means for infeeding a treatment fluid for drawing the endless filament portion and for treatment of the endless filament threads in said treatment portion;

a crimping portion arranged downstream of the treatment portion with respect to the predeterminate direction of travel of the endless filament threads;

said crimping portion having an outlet side for the endless filament threads;

a connector element connecting the treatment portion with the crimping portion;

a mouth portion provided at the outlet side of the crimping portion;

lamellae provided for the crimping portion;

each of said lamellae having a first end and a second end located remote from the first end;

said connector element being provided with slots for receiving the first ends of the lamellae;

each of said slots of said connector element having a slot base;

said mouth portion being provided with slots for receiving the second ends of the lamellae;

each of said slots of said mouth portion having a slot base;

said first ends of said lamellae being mounted in the slots of the connector element and the second ends of the lamellae being mounted in the slots of the mouth portion;

said connector element comprising two parts which are separable from one another;

said mouth portion being divided into two parts which are separable from one another;

said slots of each part of said connector element communicating with one another at the region of said slot bases by means of a cleaning groove which is accessible in the separated condition of the connector element; and said slots of each part of said mouth portion communicating with one another at the region of said slot bases by means of a cleaning groove which is accessible in the separated condition of the mouth portion.

* * * * *

UNITED STATES PATENT AND TRADEMARK OFFICE

CERTIFICATE OF CORRECTION

PATENT NO. : 4,854,019

DATED : August 8, 1989

INVENTOR(S) : WERNER NABULON

It is certified that error appears in the above-identified patent and that said Letters Patent is hereby corrected as shown below:

Column 1, line 11, after "to" please insert --herein as endless filament threads.--

Column 5, line 17, after "width" please insert --corresponding to the width B.2 of the slot or slit 29 and--

Column 5, line 39, after "into" please insert --an annular space 80 located between the external tube or tube--

Column 7, line 24, after "element" please delete "1"

Column 8, line 5, after "moving" please insert --therethrough--

Column 8, line 12, after "filament" please insert --threads through the thread infeed--

Signed and Sealed this

Ninth Day of October, 1990

*Attest:*

HARRY F. MANBECK, JR.

*Attesting Officer*

*Commissioner of Patents and Trademarks*